United States Patent [19]

Seiter

[11] Patent Number: 4,720,154

[45] Date of Patent: Jan. 19, 1988

[54] AUTOMATIC TELLER MACHINE HAVING MOTORIZED DRAWER

[76] Inventor: Stephen R. Seiter, 1785 Thames St., Clearwater, Fla. 33515

[21] Appl. No.: 932,263

[22] Filed: Nov. 19, 1986

[51] Int. Cl.[4] ..... A47B 88/00; G07G 5/00

[52] U.S. Cl. ..... 312/319; 312/331; 312/325; 109/24.1

[58] Field of Search ..... 312/331, 334, 273, 319, 312/325, 341 R; 109/2, 11, 24.1; 52/67; 384/19

[56] References Cited

U.S. PATENT DOCUMENTS

| | | | |
|---|---|---|---|
| 316,294 | 4/1885 | Roberts | 312/331 |
| 3,284,153 | 11/1966 | Goodacre | 312/331 |
| 4,121,876 | 10/1978 | Ratti | 384/19 |
| 4,134,629 | 1/1979 | Hansen | 312/273 |
| 4,183,596 | 1/1980 | Greene et al. | 312/334 |
| 4,368,937 | 1/1983 | Palombo et al. | 312/325 |
| 4,513,670 | 4/1985 | Berman | 109/24.1 |
| 4,557,352 | 12/1985 | Tschappat, Jr. | 52/67 |
| 4,577,562 | 3/1986 | Berman | 52/67 |
| 4,603,643 | 8/1986 | Couvrette | 109/2 |

*Primary Examiner*—Victor N. Sakran
*Attorney, Agent, or Firm*—Stanley M. Miller

[57] ABSTRACT

An automatic teller banking device of the type used in connection with drive through banking facilities. The device is a kiosk positioned on a traffic island so that bank customers may remain in their vehicles while conducting banking transactions in the absence of human tellers. The island kiosk is generally rectangular in shape and includes a motorized drawer in its medial portion. The drawer may extend outwardly from the kiosk to block a traffic lane when the land is closed, and maintenance of the device may be performed when the drawer is in its out or extended position. Three telescopically nested platforms carry the movable drawer. A pivotally mounted lever arm is pivoted about a first, permanently positioned pivot point by a linear actuator. A pushrod having a first end pivotally mounted to the free end of the lever arm and a second end secured to the topmost of the three platforms carries the topmost platform out when the lever arm is displaced by the actuator.

17 Claims, 11 Drawing Figures

AUTOMATIC TELLER MACHINE HAVING MOTORIZED DRAWER

BACKGROUND OF THE INVENTION

1. Field of the Invention

This invention relates to automatic teller machines, also known as ATMs, and more specifically relates to an ATM having a small structure that can be expanded when service work is to be performed or when replenishment of materials is needed.

2. Description of the Prior Art

Automatic teller machines of the island kiosk type are known.

Moreover, island kiosk constructions having drawers formed therein that may be positioned in an extended position or a withdrawn position are also known.

Island kiosks are popular because they allow banking customers to make deposits, withdrawals, get cash, and the like without leaving their vehicles. Typically, a bank will provide a plurality of driveways separated by traffic islands, and an ATM of the kiosk type will be positioned on each island.

The drawbacks of the earliest island kiosk-type ATMs are well known. Since they are positioned on small traffic islands, they must of course be small structures. ATMs are notorious for requiring frequent repairs, and repair personnel often experience difficulty in getting inside ATMs that require servicing. Moreover, cash-dispensing machines must be replenished from time to time. Other routine banking activities also require that personnel have easy and frequent access into the kiosk.

Typically, a structure will be provided with a small, moveable portion that is movable in some fashion so as to be received within or extended from the larger, fixed position kiosk. The telescoping portion of the structure can then be extended outwardly relative to the main structure to allow room inside the device for service personnel to move around without much restriction.

The expansion of the kiosk also serves the purpose of blocking the driveway with which it is associated; this prevents customers from trying to use the device while it is being repaired. Moreover, when management decides to close a lane to traffic for any other reason, the extended kiosk effectively blocks the driveway as desired.

One of the early efforts to provide a extensible kiosk is documented in U.S. Pat. No. 4,513,670 to Berman, awarded in April, 1985. An attempt to improve the state of the art is documented in U.S. Pat. No. 4,557,352 to Tschappat which also issued in 1985.

Mr. Berman improved his first ATM structure, and was awarded U.S. Pat. No. 4,577,562 in March, 1986. The most recent patent in the field, however, appears to be U.S. Pat. No. 4,603,643 to Couvrette, awarded Aug. 5, 1986.

The island kiosks developed by the aformentioned inventors accomplish their respective objectives and have added to the store of knowledge vis a vis expandable ATMs, but the present inventor has achieved breakthroughs in the field which significantly advance the art.

More specifically, any banking device of the type that holds and dispenses cash should be of very sound construction. Moreover, expandable island kiosks should be built to withstand frequent extensions and retractions of their moveable sections.

The construction arts are well advanced in general and it is no problem to build a heavy duty structure. However, a structure built with strength in mind is usually large, not compact. If a part of a heavy duty structure is designed to move, it is typically designed to move slowly.

The structures of the prior art are also in need of improvement because if one closely examines their respective constructions, one will observe that they rely heavily on close tolerances between the various moving parts. Close tolerances are typically associated with overly complex, inelegant structures.

The present invention provides a heavy duty structure with moveable parts that can be moved from one position to another speedily; neither speed nor power is sacrificed and the need to maintain careful attention to close tolerances is obviated.

SUMMARY OF THE INVENTION

The present structure has a rectangular planform when in its non-expanded configuration, and has a "T"-shaped planform when its motorized drawer is extended.

In the preferred embodiment, the motorized drawer is positioned mid-length of the rectangular structure.

A door that permits access into the kiosk is preferably positioned at one end thereof. A heat pump is provided within the kiosk as well since temperature control is required to ensure long life of the electronic part housed within the ATM. Accordingly, the heat pump is positioned at a first end of the structure, the access door at a second end thereof, and the motorized drawer is positioned intermediate said first and second ends.

The depth of the motorized drawer is just a little less than the depth of the kiosk itself; thus, when the drawer is in its retracted position, it does not block its associated traffic lane. However, maintenance personnel cannot work on the electronic parts inside the drawer when it is retracted, nor can the heat pump be serviced when the drawer is so situated.

It is important, therefore, that the drawer be moved into its extended position from time to time.

The complicated linkages and other mechanism of the prior art devices are not employed in the present inventive structure.

A simple yet very strong arrangement of parts is instead provided. Specifically, a three piece cradle of the progressive suspension type is provided. Due to the small number of parts, the drawer can be moved quickly. However, due to the telescoping construction, the parts are strong and able to withstand frequent and rapid openings and closings of the kiosk.

The telescoping members are driven by a linear actuator motor and the kiosk includes a first limit switch that turns the motor off when the drawer achieves its fully extended position and a second limit switch that turns the motor off when the drawer achieves its fully retracted position.

Only three main parts are needed to construct the slideable mounting means for the motorized drawer. The first part is a base member mounted on a permanent platform. The base member stays within the kiosk even when the drawer is extended. The second part is separated from the base member by a first set of wheels so that it may extend outwardly with respect to the base member, and a third part is separated from the second part by a second set of wheels so that it may extend beyond said second part.

The three telescoping members are extended by a motor; the motor operates a telescoping arm or linear actuator that reciprocates axially between limits set by limit switches, which limits may be adjusted as desired. An axially outward movement of the actuator is effective to move the drawer out and an axially inward movement of the actuator is effective to retract the drawer.

A three piece linkage consisting of the linear actuator, a pivotally mounted lever arm and a push rod mounted on a free end of the lever arm is effective to push the third telescoping member and hence the drawer into its extended position.

More specifically, the lever arm has a first, fixed position end that is pivotally mounted. The lever arm is pivotally engaged by the linear structure at a point between its fixed position, pivotally mounted end and its free end. Thus, the point of engagement of the linear actuator and the lever arm is a fulcrum.

A pushrod is pivotally secured at its free end to the free end of the lever arm and the second end of said pushrod is secured to the third or topmost member of the nested members.

Thus, when the linear actuator axially extends, the lever arm pivots about its fulcrum and the pushrod is axially advanced, carrying the topmost telescoping member with it.

The second telescoping member follows the third outwardly but its inner half remains retracted and engaged to the outer half of the non-moving base member. Similarly, the third or topmost member has its inner half disposed in cantilevered relation to the outer half of the second telescoping member when the drawer is fully extended.

A small, slow movement of the linear actuator is translated into a large, relatively fast displacement of the topmost telescoping member by positioning the above-described fulcrum in close spatial relation to the fixed position pivot point of the lever arm. Thus, the pushrod is spaced substantially further from the fulcrum than is the fixed position pivot point of the lever arm, with the result that the movement of the actuator is amplified in accordance with leverage principles.

The topmost of the three telescoping members is wider than the second member which second member in turn is wider than the base member; thus, wheel members carried by the topmost member rollingly engage outwardly facing channels formed by the second or intermediate member, and wheel members carried by the intermediate member rollingly engage outwardly facing channels formed in the base member.

Thus, when the pushrod is axially advanced, the third or topmost member rolls outwardly with respect to the intermediate member which intermediate member rolls outwardly with respect to the base member; the speed of the topmost member will be about twice as fast as the speed of the intermediate member.

An important object of this invention is to provide a heavy duty expandable structure having a small number of parts that are nested together in a configuration that does not require close tolerances.

Another important object is to provide an expandable structure that may be opened and closed quickly.

The invention accordingly comprises the features of construction, combination of elements and arrangement of parts that will be exemplified in the construciton hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENT

Figure 1:
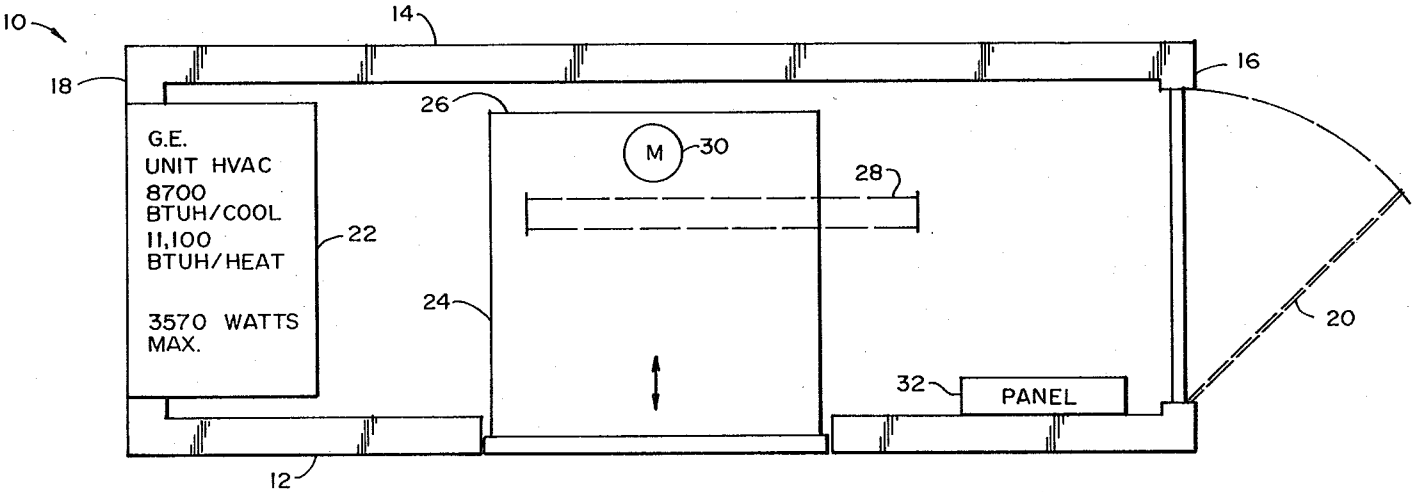
FIG. 1 is a plan view of an illustrative embodiment of the novel kiosk.

Referring now to FIG. 1, it will there be seen that the novel structure 10 is generally rectangular in its preferred embodiment.

Kiosk 10 includes front wall 12, back wall 14, first end wall 16 and second end wall 18. An outwardly swinging door 20 is hingedly mounted in a door jamb framing an access opening in end wall 16, and a heating, ventilating, and air conditioning (HVAC) unit 22 is positioned adjacent end wall 18.

The motorized drawer is denoted 24. It includes rear wall 26 that is closely spaced relative to kiosk rear wall 14.

Walls 12, 14, 16 and 18 as well as door 20 are insulated to reduce the load on HVAC unit 22. A light fixture of the fluorescent type is mounted on the ceiling of the structure 10 and is denoted 28.

The motor that effects extension and retraction of the motorized drawer is denoted 30. It is positioned beneath the lowermost member of the three member telescoping mechanism upon which drawer 24 is mounted.

A control panel 32 is mounted on front wall 12 as shown; the HVAC unit 22, the light 28 and the motor 30 may be controlled at panel 32.

Figure 2:
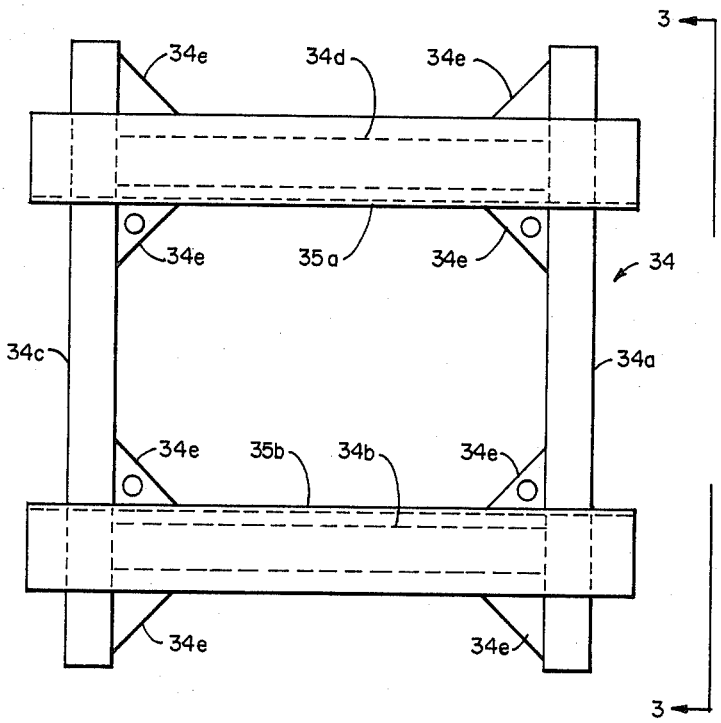
FIG. 2 is a plan view of the lowermost or base member that provides the foundation for the moving parts of the novel structure.

Base member 34 appears in plan view in FIG. 2. Although the precise dimensions are not important and can be varied at will without inventive effort, the size of base member 34 is roughly three feet square, and the size of the intermediate and topmost members telescopically engaged with it are successively larger.

The frame of part 34 consists of four square in section tubular members denoted **34*a*, 34*b*, 34*c* and 34*d*. Wedge-shaped brace members, collectively denoted 34e**, make the square structure more rigid.

Figure 3:
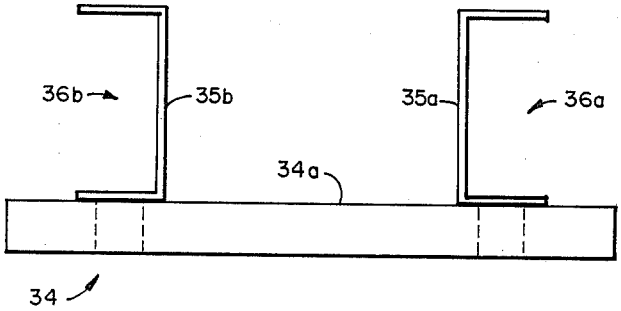
FIG. 3 is an end view of the base member shown in FIG. 2, taken along line 3—3 of FIG. 2.

A pair of elongate channel-shaped members are mounted atop the tubular frame members and are denoted 35a, 35b; the respective cavities 36a, 36b formed by the channel-shaped members are outwardly facing as best understood in connection with FIG. 3.

Perhaps it should be pointed out that in FIG. 2, front wall 12 is not shown but would be parallel to and to the left of member 34c if it were shown, and that, accordingly, if kiosk back wall 14 were shown in FIG. 2, it would be parallel to and to the right of member 34a. In FIGS. 2–9, in other words, the motorized drawer 24 of the present invention would open to the left of the page, but in FIGS. 10 and 11 the device is depicted opening to the right of the page.

Figure 4:
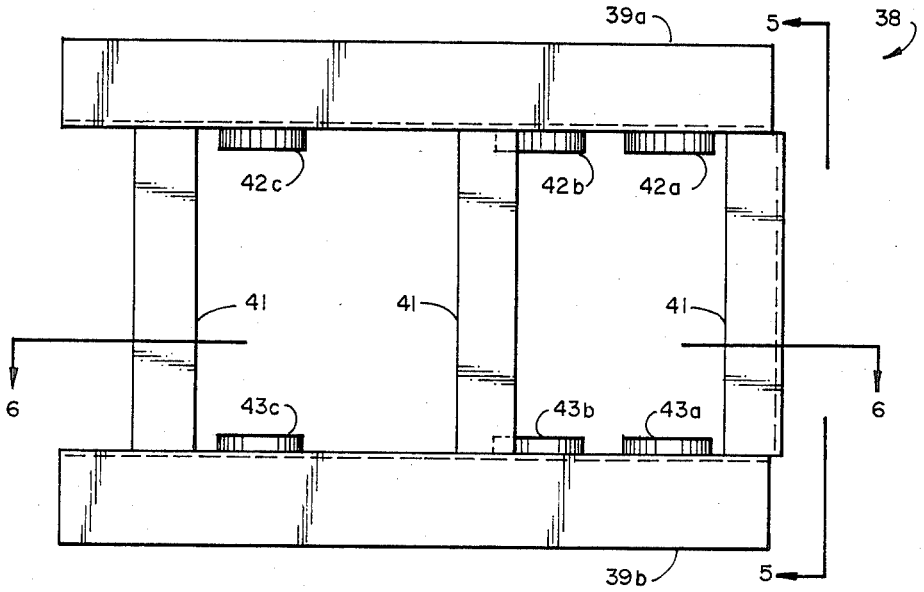
FIG. 4 is a plan view of the intermediate part that is carried by the base member.

FIG. 4 provides a top view of the part that is carried by base member 34; said part is the intermediate member of the three member cradle and is denoted 38 as a whole. It includes outwardly-facing channel-shaped members 39a, 39b which respectively define cavities 40a, 40b as best shown in FIG. 5.

The channel members 39a, 39b are interconnected to one another at spaced intervals as shown by three brace members that are collectively designated 41.

Figure 5:
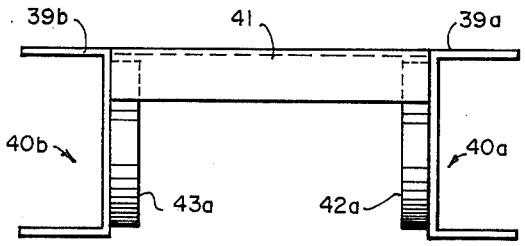
FIG. 5 is an end view of the part shown in FIG. 4, taken along line 5—5 of FIG. 4.

Three wheel members, denoted 42a, 42b and 42c are rotatably mounted on the inside face of channel member 39a, and wheel members 43a, 43b and 43c are rotatably mounted on the inside face of channel member 39b as clearly depicted in FIGS. 4 and 5.

Wheel members 42a, 42b and 43c rollingly engage channel 36a (FIG. 3) of channel member 35a (FIG. 3) which channel member 35a forms a part of base member 34; similarly, wheels 43a, 43b and 43c rollingly engage channel 36b of channel member 35b. Thus, the members 41 (FIG. 4) that interconnect channel members 39a, 39b have a length sufficient to allow the wheels of FIGS. 4 and 5 to engage the channels 36a, 36b of FIGS. 2 and 3. In this manner, base member 34 and intermediate member 38 are nested or telescopically engaged.

Figure 6:
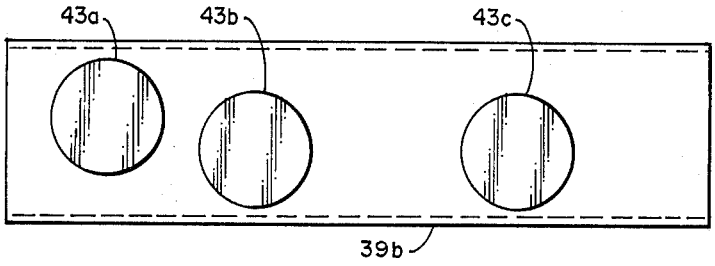
FIG. 6 is an elevational view taken along line 6—6 in FIG. 4.
Figure 9:
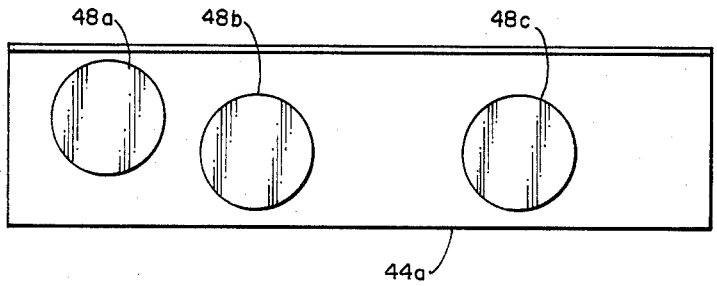
FIG. 9 is an elevational view taken along line 9—9 in FIG. 7.
Figure 7:
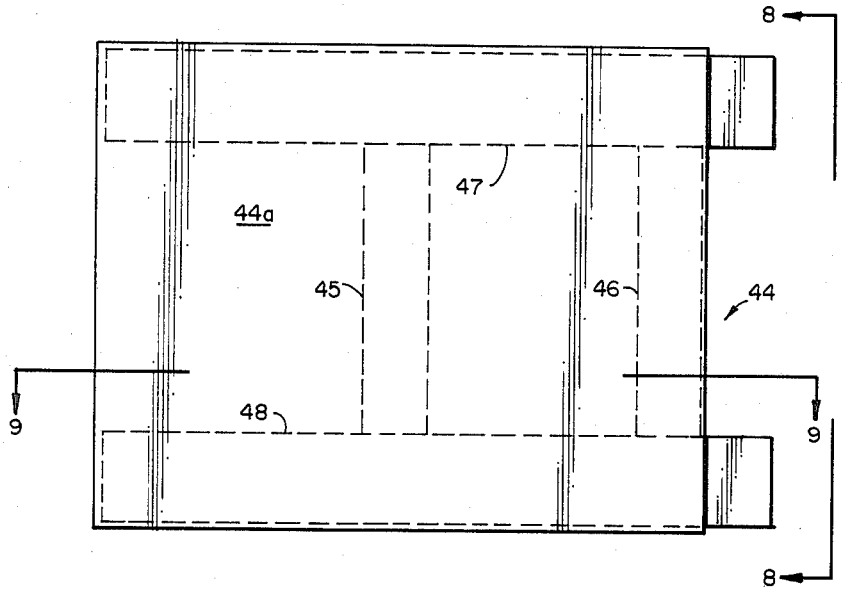
FIG. 7 is a plan view of the uppermost member of the telescoping cradle shown in the previous FIGS.
Figure 8:
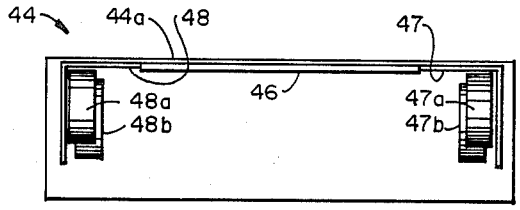
FIG. 8 is an end view of the part shown in FIG. 7, taken along line 8—8 of FIG. 7.

As indicated in FIG. 6, wheel 42a rollingly engages channel member 35a along its upper flange whereas wheels 42b, 42c rollingly engage its lower flange. Similarly, wheel 43a rollingly engages the upper flange of channel member 35b whereas wheels 43b, 43c rollingly engages its lower flange. This prevents rocking of the base member 34 with respect to the intermediate member 38.

The third or uppermost part of the telescoping cradle does not have outwardly opening channel members since it is the outermost of the nested parts. Said third part is designated 44 in FIGS. 7 and 8; it includes a pair of flat brace members 45, 46 that interconnect support members 47, 48. It also includes a flat plate 44a upon which is mounted that portion of the ATM which interfaces with customers.

Another set of three wheels, 47a, 47b and 47c rollingly engage channel 40a of member 39a (FIG. 5) and another set of wheels 48a, 48b and 48c rollingly engage channel 40b of channel member 39b (FIG. 5).

As in the intermediate structure, the wheels are offset to rollingly engage oppositely disposed flanges of their respective channel members to substantially reduce rocking action.

Figure 11:
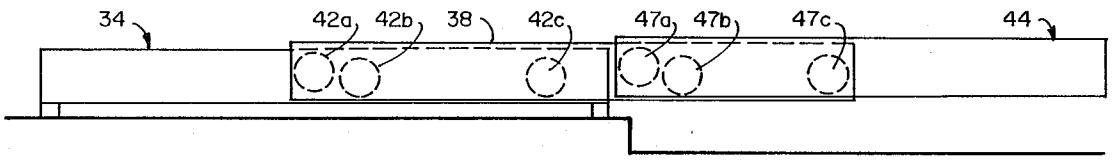
FIG. 11 is a side elevational view taken along line 11—11 of FIG. 10.

FIG. 11 depicts the three telescoping parts 34, 38 and 44 when the same are in their nested configuration. As described hereinabove, FIG. 11 suggests that the wheels of the intermediate part 38 lie outwardly of base member 34 and rollingly engage its outwardly opening channel members, in the same manner that the outermost member 44 engages said intermediate member 38.

Figure 10:
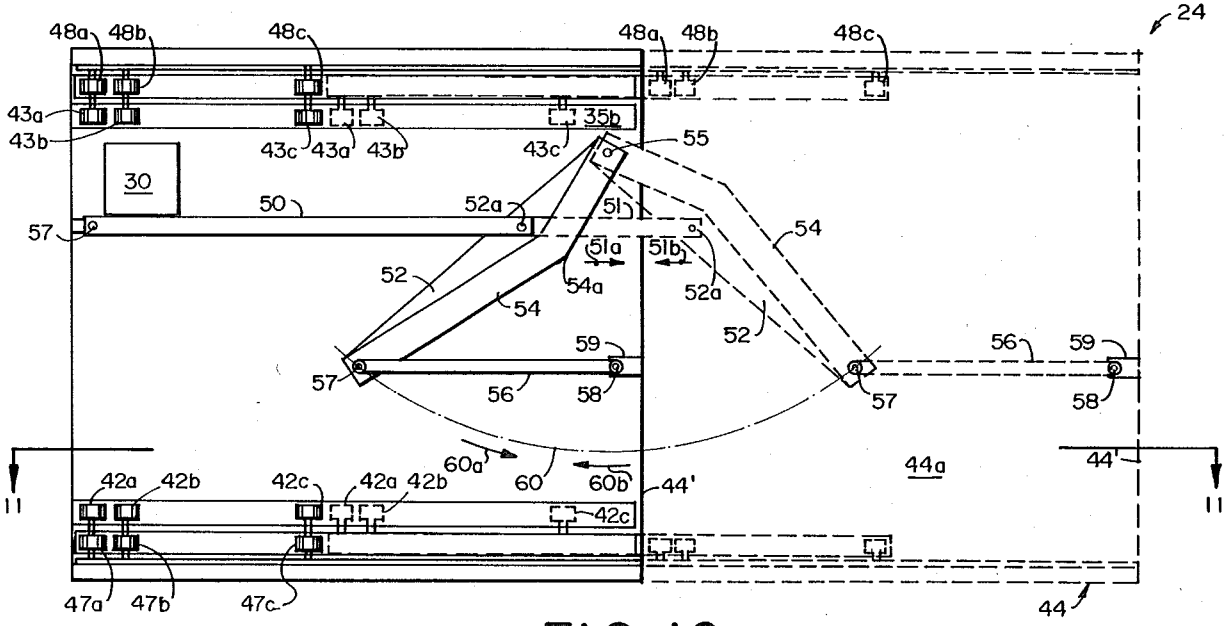
FIG. 10 is a plan view showing all three telescoping members and the three part linkage that effects their extension and retraction.

FIG. 10 shows motor 30 as mounted on base member 34. A linearly actuated telescoping shaft 50 having plunger 51 is operatively connected to the motor so that when the motor is activated by a person at control panel 32, said plunger 51 extends axially with respect to shaft 50 until drawer 24 is fully extended at which position it hits a first limit switch that turns off the motor. Conversely, plunger 51 travels axially inward with respect to shaft 50 when motor 30 is activated again and a second limit switch turns off the motor when drawer 24 is fully retracted.

The outward movement of plunger 51 is indicated by directional arrow 51a in FIG. 10 and its inward movement is indicated by directional arrow 51b.

Plunger 51 is pivotally secured as at 52a to a guide means 52 which guide means is an integral part of lever arm 54.

Lever arm 54 is an elongate, rigid member having a bend 54a formed therein as shown; importantly, lever arm 54 has one end that is pivotally mounted as at 55. Pivot point 55 is a fixed position; referring once more to FIG. 2, it should be apparent that the wedge-shaped brace member 34e at the lower left hand corner of said FIG. 2 could provide pivot point 55 and FIG. 2 is marked accordingly; again, it must be appreciated that the drawings of FIGS. 2–9 are reversed with respect to FIGS. 10 and 11.

As shown in FIG. 10, pushrod 56 has a first or inward end pivotally secured as at pivot point 57 to the free end of lever arm 54. The outer end of pushrod 56 is secured to the leading edge 44' of the uppermost cradle member 44 at point 58 on ear 59 which ear is fixedly secured to said leading edge 44' of top member 44.

Thus, it is clear that lever arm 54 has a fulcrum at point 52a where plunger 51 pivotally engages guide means 52 and hence lever arm 54.

Axial extension of plunger 51 in the direction indicated by arrow 51a thus causes point 57 where pushrod 56 pivotally engages lever arm 54 to follow the arc denoted 60 in the direction indicated by arrow 60a.

Conversely, axial retraction of plunger 51 in the direction indicated by arrow 51b will cause point 57 to retrace its path as denoted by arrow 60b.

Thus, since pivot point 55 is a fixed position point as aforesaid, the arcuate path swept by fulcrum pivot point 52a will be much shorter than the path denoted 60 and the speed of point 57 will be correspondingly greater than the speed of point 52.

In this manner, an amplification of the motion of plunger 51 is achieved; speed is attained without sacrificing power.

It is also worth mentioning that the length of pushrod 56 is adjustable so that the novel ATM can be installed in a variety of physical environments. For the same reason, the length of the actuator's stroke is also adjustable since said length is a function of the positioning of limit switches.

An emergency disconnect of motor 30 is also provided in the vicinity of pivot point 57.

Moreover, it should be pointed out that once plunger 51 is extended as depicted in phantom lines in FIG. 10, it will self-lock into such position. This self-locking feature is a function of the worm gear arrangement between motor 30 and the actuator 50 and plunger 51, and of the levered arrangement of the lever arm 54.

The intermediate member 38 will follow top member 44 outwardly when plunger 51 extends, due to the rolling interconnection thereof by the wheel members. The plunger is not connected to said intermediate or middle member.

When the top member 44 is fully extended as indicated in phantom lines in FIG. 10 and in solid lines in FIG. 11, intermediate member 38 will be disposed in cantilevered relation to base member 34 and top member 44 will be disposed in cantilevered relation to the middle member 38.

More specifically, middle member 38 will be extended half way out of its fully retracted position as is clearly depicted in FIGS. 10 and 11.

However, top member 44 is fully extended from its retracted position as is clear from said FIGS. 10 and 11; the ATM parts are accordingly mounted to said top member 44.

Top member 44 is half extended with respect to middle member 38, however, as is clear from the drawings. In this manner, a progressive extension is achieved and the limits of the cantilever arrangement are not exceeded.

It should be clear that top member 44 travels twice as fast as middle member 38.

The mechanical advantage achieved by the ingenuous provision of pushrod 56, lever arm 54, and the pivotal arrangements thereof with respect to plunger 51 is manifested by the speedy extension and retraction of the drawer 24. Since these parts and their associated wheel members can be made of heavy duty construction with minimal attention to tolerances, the object of providing a heavy duty but nimble expandible ATM structure is fully and efficiently realized.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An expandable structure having utility as an automatic teller machine of the island kiosk type, comprising:

a fixed position structure having a generally rectangular planform;

said structure including a motorized movable drawer having a retracted position and an extended position;

a support means for said motorized drawer;

said support means including a plurality of nested, telescoping members that progressively extend out of said structure when said drawer is moved into an extended position;

a linear actuator means for effecting extension and retraction of said drawer;

leverage means for amplifying the effect of said linear actuator means;

said telescoping members including a base member, an intermediate member and a top member;

said leverage means including a lever arm member having a fixed position, pivotally mounted proximal end, a pushrod member having a first end pivotally secured to a distal end of said lever arm member, and said pushrod member having a second end pivotally secured to said top member;

said linear actuator means pivotally secured to said lever arm member at a point between the fixed position, pivotally mounted proximal end of said lever arm member and the distal end of said lever arm member;

whereby a fulcrum means is established at the point of pivotal connection between said actuator means and said lever arm member;

whereby the linear actuator means operates at a slow speed but effects a relatively high speed extension or retraction of said drawer as a result of said amplifying means; and whereby the linear actuator means travels a relatively short distance yet effects travel by said drawer over a greater distance.

2. The structure of claim 1, wherein said actuator means is pivotally secured to said lever arm at a point closely spaced to its fixed position pivot point and remotely spaced relative to the distal end of said lever arm.

3. The structure of claim 2, further comprising friction-reducing means for reducing friction between said nested members, said friction-reducing means comprising first and second sets of wheel members carried by said intermediate and top members respectively which wheel members rollingly engage said base and intermediate members respectively.

4. The structure of claim 1, wherein said base member includes a pair of parallel, spaced apart channel members positioned with respect to each other such that respective channel-shaped cavities defined by them face outwardly in relation to said base member and in opposite directions relative to each other, and wherein said channel members are mounted on a generally square in configuration frame means.

5. The structure of claim 4, wherein said intermediate member is a frame means that carries a plurality of rotatably mounted wheel members that rollingly engage the channel-shaped cavities defined by the channel members of said base member.

6. The structure of claim 5, wherein the frame means of said intermediate member further comprises a pair of parallel, spaced apart channel members positioned with respect to one another such that their respective channel-shaped cavities face in the same direction as the channel-shaped cavities of said base member.

7. The structure of claim 6, wherein said top member is a frame means that carries a plurality of rotatably mounted wheel members that rollingly engage the respective cavities defined by the channel members of said intermediate member.

8. The structure of claim 7, wherein said top member supports a flat platform member upon which said motorized drawer is mounted.

9. The structure of claim 8, wherein the wheels carried by said top member are positioned below the plane of said platform member.

10. The structure of claim 9, further comprising a motor means for operating said linear actuator means, said motor means including an output shaft, said actuator means including an elongate, telescoping shaft and plunger disposed normal to said motor means output shaft, and gear means interconnecting said motor means output shaft and said telescoping shaft so that the plunger is retracted and extended responsive to operation of said motor means.

11. The structure of claim 10, wherein equal numbers of said wheel members are mounted on opposite sides of said intermediate member to rollingly engage the channel-shaped cavities of said base member, and wherein a first quantity of said wheel members rollingly engage a first flange of their associated channel member and wherein a second quantity of said wheel members rollingly engage a second flange of their associated channel member.

12. The structure of claim 11, wherein equal numbers of said wheel membes are mounted on opposite sides of said top member to rollingly engage the channel members of said intermediate member, and wherein a first quantity of said wheel members rollingly engage a first flange of their associated channel member and wherein a second quantity of wheel members rollingly engage a second flange of their associated channel member.

13. The structure of claim 1, further comprising an actuator quide means associated with said lever arm, said linear actuator means being pivotally connected to said guide means.

14. The structure of claim 13, wherein said lever arm has an obtuse bend formed therein near its connection with said linear actuator means.

15. The structure of claim 1, further comprising adjustable limit switch means to selectively limit the travel of said linear actuator means and hence of said drawer.

16. The structure of claim 1, wherein one member of said nesting members remains within the fixed position structure when other nested members are in their extended dispositions.

17. A progressively extensible platform, comprising:

a base member;

said base member including first wheel support means for rollingly engaging wheel members;

an intermediate member;

said intermediate member including second wheel support means for rollingly engaging wheel members;

a top member;

a first set of wheel members rotatably mounted to said intermediate member;

said first set of wheel members being disposed in rollingly engagement with said first wheel support means;

a second set of wheel members rotatably mounted to said top member;

said second set of wheel members being disposed in rolling engagement with said second wheel support means;

said base, intermediate and top members positioned in nesting relation to one another and movable between a retracted position and an extended position attendant rolling of said first and second sets of wheel members;

actuator means for moving said top member into its extended position and its retracted position;

said intermediate member following said top member when said top member is extended or retracted by said actuator member;

said base member remaining in a fixed position;

a leverage mechanism for effecting outward and inward travel of said top member;

said leverage mechanism including a friction reducing means positioned intermediate said nested members and;

a linear actuator means and;

a lever arm having a pivotally mounted, fixed position proximal end and; a pushrod;

said pushrod having a distal end pivotally secured to said top member;

said pushrod having a proximal end pivotally secured to a distal end of said lever arm;

and said linear actuator means having a distal end pivotally secured to said lever arm at a point between the fixed position pivotally mounted proximal end and the distal end of said lever arm;

whereby a fulcrum means is established at the point of pivotal connection between the linear actuator means and the lever arm.

* * * * *